United States Patent [19]

Baer

[11] Patent Number: 5,001,810

[45] Date of Patent: Mar. 26, 1991

[54] PINLESS HINGE STRUCTURE WITH SELF-OPERATING FEATURES

[76] Inventor: Austin R. Baer, 1115 N. Ellsworth, Villa Park, Ill. 60181

[21] Appl. No.: 443,572

[22] Filed: Nov. 29, 1989

[51] Int. Cl.[5] ..... E05F 1/08; E05F 1/02; E05D 7/00

[52] U.S. Cl. ..... 16/302; 16/308; 16/354

[58] Field of Search ..... 16/354, 287, 302, 308

[56] References Cited

U.S. PATENT DOCUMENTS

| | | | |
|---|---|---|---|
| 3,092,870 | 6/1963 | Baer | 16/354 |
| 3,402,422 | 9/1968 | Baer | 16/354 |
| 3,787,923 | 1/1974 | Peterson . | |
| 4,284,861 | 8/1981 | Senften . | |
| 4,583,262 | 4/1986 | Werner . | |
| 4,679,277 | 7/1987 | Shibata | 16/354 |
| 4,761,853 | 8/1988 | Hoffman | 16/302 |

*Primary Examiner*—Richard K. Seidel
*Assistant Examiner*—Carmine Cuda
*Attorney, Agent, or Firm*—Gravely, Lieder & Woodruff

[57] ABSTRACT

A pinless hinge structure including a pair of longitudinally extending hinge members which are rotatably joined to each other and a longitudinally extending clamp member for maintaining said hinge member in rotatable association relative to each other. A torsion spring engages each hinge member and provides a self-operating feature to the hinge structure.

16 Claims, 3 Drawing Sheets

PINLESS HINGE STRUCTURE WITH SELF-OPERATING FEATURES

FIELD OF THE INVENTION

The present invention generally relates to hinge structures and, more particularly, to a pinless hinge structure operable between open and closed positions and including two hinge members which are spring-biased in opposite directions relative to each other.

BACKGROUND OF THE INVENTION

A hinge structure typically includes two hinge members which are rotatably secured together by a pin or the like. Automatically operated doors, such as those commonly used in shopping centers, schools, or the like, are continually operated and are substantially heavier and larger than those used in most homes. As will be understood, continual use of a door submits the hinge structure to extensive wear. Notwithstanding their continual use and the substantial loads placed thereon, a hinge structure is expected to perform error-free and with minimum maintenance.

Increases in height and/or weight of the door, or the like, carried by the hinge member, adds to the frictional sliding contact between the hinge members and thereby increases the wear on the hinge structure. As may be appreciated, and despite the wear on such hinge structures, the hinge members are not normally permitted to longitudinally move relative to each other during their operation.

My U.S. Pat. No. 3,092,870 dated June 11, 1963, discloses a pinless hinge structure offering increased performance and durability. Such a hinge structure includes two longitudinally extending hinge members which are rotatably joined along adjacent longitudinal edges by intermeshing gear segments forming part of the hinge members and which define a hinge joint. A clamp member maintains the gear segments in mesh relative to each other while permitting smooth and uniform movement of the hinge members through a full arc of travel of the hinge. The clamp member has a generally C-shaped cross section whose inwardly turned ends are formed with longitudinally extending rod-like portions. Each rod-like portion on the clamp member fits within a longitudinal channel formed in the gear segment and defines a fixed axis of rotation for each hinge member.

The design and performance of the hinge structure disclosed in the above-identified patent was further enhanced through the provision of a longitudinal thrust bearing which was the subject of my U.S. Pat. No. 3,402,422 dated Sept. 24, 1968. My patented longitudinal thrust bearing comprises a solid bearing member disposed in longitudinally co-extensive recesses formed in adjacent longitudinal edges of each rotatable hinge member for inhibiting longitudinal movement of one hinge member with respect to the other hinge member. Preferably, several thrust bearing assemblies are longitudinally spaced along the length of the door to distribute their load bearing capability.

For appearance and privacy, buildings are frequently provided with self-closing cabinets and other closures. Moreover, fire safety doors on buildings are commonly designed with a self-closing feature. Therefore, there is both a need and a desire for hinge structures which impart a self-operating feature to the door, or the like, mounted thereon.

Electrical alarm systems are commonly used for monitoring whether a door is secured and/or the relative angular position thereof. Such alarm systems typically include a separate conduit or wire which bridges the rotatable hinge joint between the hinge members. Moreover, some door-mounted, electrically operated mechanisms such as locks, panic bars, automatic actuators, and the like, typically require high-level electric current to be passed across the rotatable hinge joint of a hinge structure to operate such mechanisms. To combine the ability to transmit electrical power across a rotatable hinge joint of a hinge structure with the above-described self-operating feature would simplify the hinge structure design and would furthermore lessen the parts required to effect such ends and, thereby, advantageously reduce the hinge structure costs.

SUMMARY OF THE INVENTION

In view of the above, and in accordance with the present invention, there is provided a hinge structure having two longitudinally extending hinge members which are maintained in rotatable association with each other by a clamp member. A torsion spring is provided in combination with the hinge structure for imparting a self-operating feature thereto. In a preferred form, the spring transmits electrical current across a rotatable hinge joint defined between the hinge members.

The hinge members are rotatably joined to each other throughout their range of movement between open and closed positions. In a preferred form of the invention, the hinge members have mutually intermeshing gear segments provided along adjacent longitudinal edges thereof and which define the rotational hinge joint of the hinge structure. The clamp member is configured with longitudinally extending, inwardly turned ends about which each of the hinge members rotates.

A series of thrust bearing assemblies are disposed along the length of the hinge members. Each thrust bearing assembly includes a thrust bearing member which is accommodated within co-extensive lateral recesses defined along adjacent longitudinal edges of the hinge members. At least a portion of the thrust bearing member extends across adjacent longitudinal edges of the hinge members and defines upper and lower bearing surfaces which slidably engage upper and lower surfaces of the recesses defined by the hinge members in a manner inhibiting relative longitudinal movement of the hinge members. Preferably, the thrust bearing member is formed from a non-metallic material for reducing frictional contact between it and the hinge members and thereby advantageously increasing the durability of the bearing assembly.

The torsion spring engages each of the hinge members and provides a self-operating feature to the hinge structure. The torsion spring includes longitudinally spaced and opposed leg portions which are joined by an elongated central portion. Each leg portion laterally extends from the central portion and through the lateral recess in the hinge member which it engages. In one form of the invention, the torsion spring provides a self-closing feature to the hinge structure. In another form of the invention, the torsion spring provides a self-opening feature to the hinge structure.

The central portion of the torsion spring longitudinally extends between the thrust bearing member and an interior surface of the clamp member. Preferably, the central portion of the torsion spring is captively retained by one or more of the thrust bearing members for a distance sufficient to provide a greater or lesser torsional force (depending upon the length and diameter of the spring), provided the leg portions of the spring are suitably anchored in relation to the hinge members. To inhibit lateral movement while allowing rotational movement of the central portion of the spring, the bearing member is preferably formed with one or more retaining grooves which accommodate the central portion of the spring.

In an alternative embodiment, the central portion of the spring is bent upon itself to form a U-shaped configuration having generally parallel sections. The parallel sections of the torsion spring are sufficiently close together that they may be inserted in pairs of retaining grooves provided on the bearing member. Leg portions on the spring extend laterally away from the respective sections of the central portion of the spring in substantially coplanar relation to each other, through the lateral recesses formed in the hinge members, and are suitably secured to the hinge structure to impart a self-operating feature thereto. This alternative design of the torsion spring advantageously applies forces in laterally displaced opposition to one another but at substantially similar locations on the hinge members thereby avoiding twisting action to the hinge structure.

If so desired, the retaining grooves for accommodating the central portion of the torsion spring can be defined on the clamp member rather than the bearing member. Alternatively, both the clamp member and thrust bearing define opposed grooves for accommodating and retaining the central portion of the torsion spring.

When used in combination with an alarm system, the torsion spring is capable of transmitting electrical current across the hinge joint of the hinge structure. One leg portion of the torsion spring is electrically joined to that part of the alarm system on one side of the hinge joint, while the opposite leg portion of the torsion spring is electrically joined to that portion of the alarm system on the other side of the hinge joint. Alternatively, electrical conduits or wires for an alarm system can longitudinally extend along the retaining grooves formed on either the bearing member or the clamp member for security purposes.

A salient feature of the present invention is the ability to provide a pinless hinge structure with a self-operating feature. Dependent upon the design of the torsion spring, the hinge members can be biased to automatically open or automatically close the hinge structure. Moreover, the same mechanism used to impart automatic operation to the hinge members can likewise serve as part of an electrical alarm system, thereby simplifying design of such an electrical system, reducing parts, maintenance and costs for the hinge structure.

Numerous other features and advantages of the present invention will become readily apparent from the following detailed description, the accompanying drawings, and the appended claims.

DETAILED DESCRIPTION OF THE PREFERRED EMBODIMENTS

Figure 1:
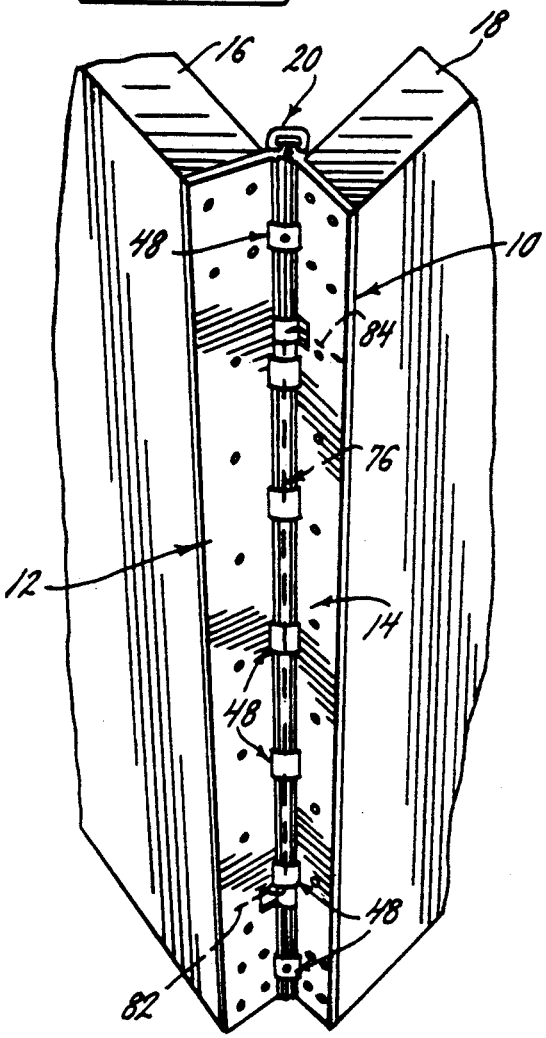
FIG. 1 is a perspective view of a hinge structure embodying the principles of the present invention.

While the present invention is susceptible of embodiment in numerous different forms, there are shown in the drawings, and will hereinafter be described, preferred embodiments of the present invention with the understanding that the present disclosure sets forth exemplifications of the invention which are not intended to limit the invention to the specific embodiments illustrated.

Referring now to the drawings, there is illustrated a pinless hinge structure 10. As illustrated in FIG. 1, the pinless hinge structure includes first and second longitudinally extending hinge members 12 and 14, respectively. Hinge member 12 is suitably secured to a door panel 16, or the like. Hinge member 14 is secured to a door panel 18, or the like. A longitudinally extending clamp member 20 maintains the hinge members 12 and 14 in rotatable engagement relative to each other.

The hinge members illustrated and described hereinafter in each of the different embodiments can be formed from a wide variety of metals, plastics, and other materials and can be fabricated by machining the elements from stock of appropriate cross section, or by rolling, drawing, die-casting or preferably, by extruding these materials. In the latter case, any extrudable material of the requisite strength may be employed such as brass, aluminum, thermoplastic polymer, and the like.

Figure 2:
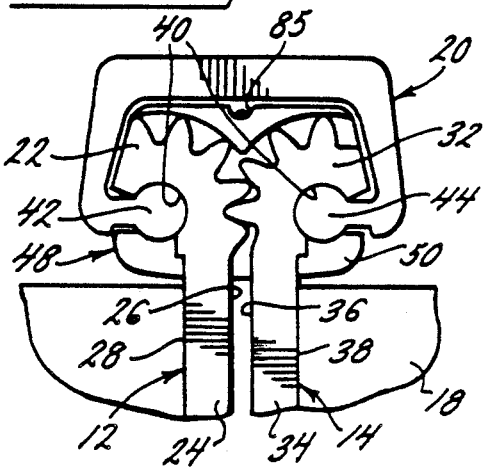
FIG. 2 is a fragmentary top plan view of the hinge structure illustrated in FIG. 1.

As illustrated in FIG. 2, the hinge members 12, 14 are rotatably joined at a hinge joint extending along their adjacent longitudinal edges. Although the illustrated configuration of the hinge members 12, 14 allows them to rotate through an arc of travel extending about 180 degrees between open and closed positions, it should be appreciated that the principles of the present invention equally apply to other hinge structures. For example, the principles of the present invention are readily applicable to a pinless hinge structure which is rotatable through an extended arc of travel. Alternatively, the principles of the present invention can be applied to a pinless hinge structure wherein each of the hinge members has a shifting axis of rotation.

In a most preferred embodiment, the first hinge member 12 is formed with a longitudinally extending gear segment 22 at one longitudinal edge and has an outwardly extending leg segment 24 joined thereto. Leg segment 24 includes inner and outer surfaces 26 and 28, respectively. The second hinge member 14 includes a longitudinally extending gear segment 32 at one longitudinal edge which intermeshes with the gear segment 22. Hinge member 14 further includes an outwardly extending leg segment 34 which is joined to gear segment 32 and includes inner and outer surfaces 36 and 38, respectively.

Each gear segment 22, 32 defines a longitudinally extending channel 40 which provides each gear segment with a longitudinally extending cylindrical bearing surface which coincides with the axes of rotation of the respective gear segments 22, 32. As shown in FIG. 2, the gear teeth of the gear segments 22, 32 intermesh to define a hinge joint about which the hinge members 14, 16 are rotatably joined to each other. The leg segments 24, 34 of the hinge members 12, 14, respectively, are secured to the door panels 16, 18, respectively. Alternatively, the leg segments of the hinge member can be configured and/or extended to provide for, an example, an intrinsically formed doorjamb or channel for windows, plate glass, or the like.

As best seen in FIG. 2, the longitudinally extending clamp member 20 has a generally channel or C-shaped cross section, and as such has legs and a web connecting the legs. The inwardly turned ends or legs of the clamp member 20 are formed with longitudinally extending rod-like bearing portions 42 and 44 which contact and cooperate with the cylindrical bearing surfaces defined by channels 40 at the axis of rotation of each hinge member. The clamp member 20 is preferably formed from a relatively rigid material or advantageously from a resilient material that will tend to maintain spring pressure against the gear segments 22, 32 in a manner maintaining mutual intermeshing relation therebetween.

The hinge members 12, 14 comprising the hinge structure are interconnected by the longitudinally extending, mutually intermeshed gear segments 22, 24 and by the longitudinal engagement of the rod-like bearing portions 42 and 44 with the channels 40 of the hinge members. As illustrated in FIG. 2, a thrust bearing assembly 48 is provided in combination with the hinge structure to inhibit longitudinal movement of the hinge members 12, 14 relative to each other.

As illustrated in FIG. 1, more than one thrust bearing assembly 48 may be provided along the length of the hinge structure to distribute the load bearing capability of the hinge structure over the length thereof. For purposes of discussion, however, only one thrust bearing assembly will be discussed in detail with the understanding that the other thrust bearing assemblies disposed along the length of the hinge structure may be substantially similar in construction.

The thrust bearing assembly 48 may be of the type disclosed in my U.S. Pat. No. 3,402,422 dated Sept. 24, 1968; the entirety of which is incorporated herein by reference. Alternatively, the thrust bearing assembly 48 may be a multi-piece construction.

Figure 3:
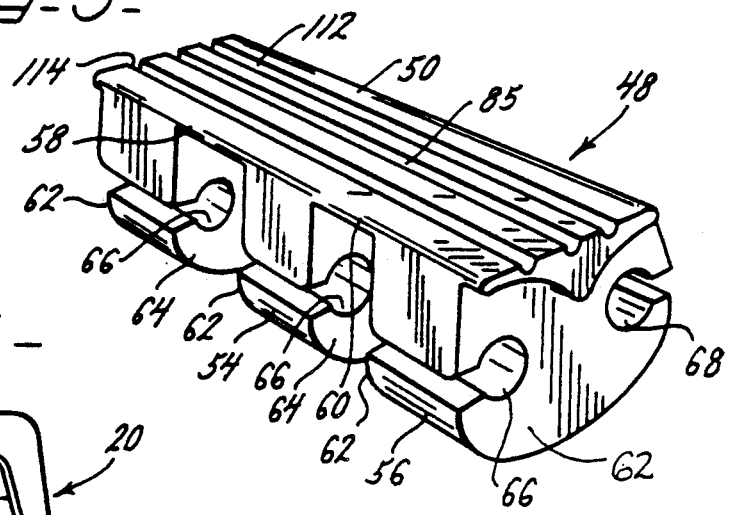
FIG. 3 is a perspective view of one form of thrust bearing that may be used in combination with the hinge structure.

As illustrated in FIG. 3, the thrust bearing assembly 48 includes an elongated thrust bearing member 50 having a series of longitudinally spaced projections 52, 54 and 56 which are joined to each other by webs 58 and 60. Preferably, the thrust bearing member 50 is a one-piece design that is molded from a non-metallic material such as acetal resin-type plastic. Such material is commonly sold under the trade name "Delrin" by DuPont Corporation.

Each projection on the bearing member 50 has a cross-sectional configuration that conforms essentially to the cross-sectional configuration of the interior of clamp member 20. Each projection further includes upper and lower bearing surfaces 62 and 64 and longitudinally extending channels 66 and 68 that receive the rod-like portions 42 and 44, respectively, of the clamp member and through which these rod-like bearing portions longitudinally extend.

Figure 4:
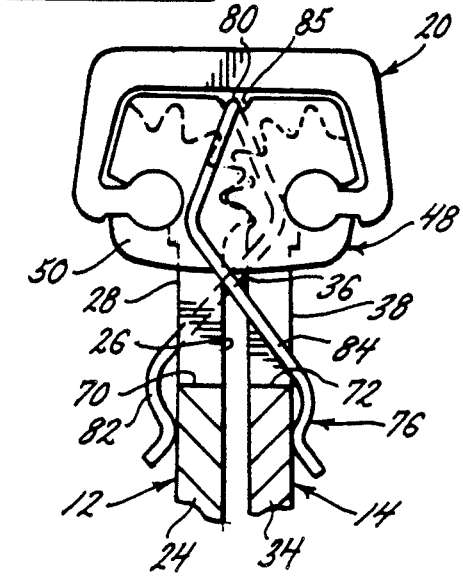
FIG. 4 is a partial sectional view illustrating hinge members of the hinge structure in a closed position.
Figure 5:
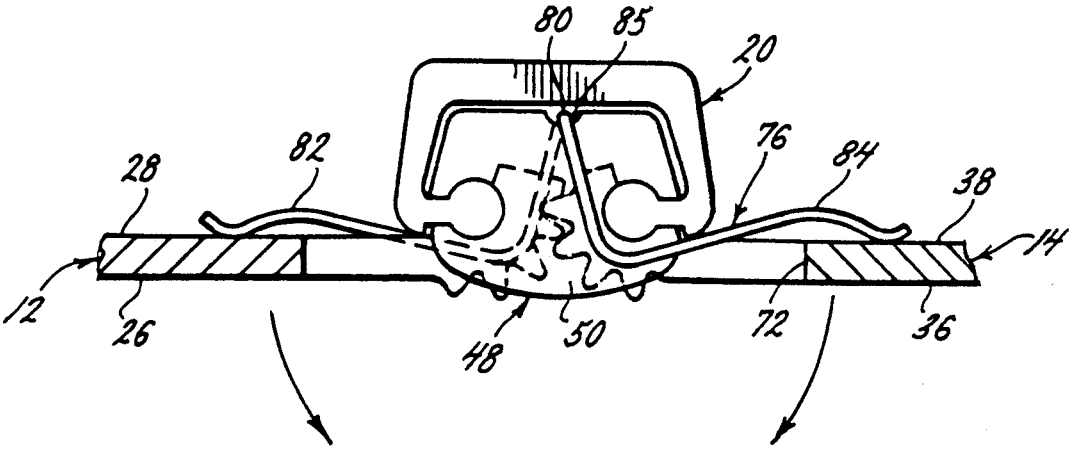
FIG. 5 is a sectional view similar to FIG. 4 illustrating the hinge members of the hinge structure in an open position.

Turning to FIGS. 4 and 5, the hinge members 12 and 14 define a series of longitudinally spaced recesses provided along adjacent longitudinal edges thereof and through which the projections 52, 54 and 56 of each bearing member 50 extend. Each recess is defined by co-extensive lateral slots 70, 72 formed in adjacent longitudinal edges of the bearing members 12 and 14, respectively.

The majority of the recesses on the hinge member each define upper and lower bearing surfaces against which the respective projections 52, 54 and 56 on the bearing member 50 slidably bear when the bearing assembly 48 is received in the recesses on the hinge members 12 and 14, respectively. The longitudinal distance between the upper and lower bearing surfaces of the recesses is equal to the longitudinal dimension separating the upper and lower bearing surfaces 62, 64, respectively, of each projection on the bearing member such that there is just sufficient clearance therebetween to permit the hinge members 12, 14 to swing or be rotated through a full range of movement extending between a closed position (FIG. 4) and an open position (FIG. 5).

Returning to FIG. 4, a torsion spring 76 engages the hinge members 12, 14 and provides a self-operating feature to the hinge structure. The torsion spring 76 is fabricated from a hardened metal wire (commonly known as "piano wire") and includes a central or rod portion 80 and opposed leg portions 82, 84. Each leg portion laterally extends from the central portion 80 in longitudinally spaced relation relative to each other.

The leg portions 82, 84 of the torsion spring 76 extend through the lateral recesses 70, 72 defined in the hinge members. As illustrated in FIGS. 4 and 5, the leg portion 84 of spring 76 extends across and above the upper bearing surface of a bearing assembly 48 arranged toward one end of the hinge structure. The leg portion 82 of spring 76 extends laterally across and beneath a lower bearing surface of another bearing assembly 48 arranged toward an opposite end of the hinge structure.

Those recesses through which the leg portions of spring 76 extend are sufficiently widened in a longitudinal direction to promote the lateral passage of the leg portions 82, 84 therethrough without causing binding entrapment of the spring between the bearing surface on the bearing assembly and the respective confronting surface defined by the recess on the hinge members. Extending the leg portions of the spring laterally across the bearing assembly inhibits the bearing member from longitudinally shifting within the widened recess. Moreover, both leg portions are provided with an angled or bent configuration which facilitates displacement thereof without operationally interfering with other parts on the hinge structure.

As illustrated in FIGS. 4 and 5, the free ends of the leg portions 82, 84 of the torsion spring 76 press against and slidably engage outer surfaces 28, 38 of the hinge members 12, 14, respectively, in a manner urging the hinge members in opposite pivotal directions relative to each other. As will be appreciated, the torsional force developed by the spring 76 will be dependent upon the spring's length and the diameter of the wire used to fabricate the spring. Knowing the torsional force required of the spring 76 to effect the desired ends, the central portion 80 of the spring should be designed to maximize the distance between the leg portions 82, 84 to reduce angular twist and angular displacement per unit of length and, thereby, reduce the spring fatigue.

As illustrated in FIGS. 4 and 5, the central portion 80 of the torsion spring 76 longitudinally extends between the thrust bearing member 50 and the interior surface of the clamp member 20. To control lateral displacement of the spring 76, the bearing member 50 defines a longitudinally extending channel or groove 85 which captively receives and retains the central portion 80 of the spring 76 in a manner inhibiting lateral displacement while allowing rotational movement of the central portion of the torsion spring along and about a longitudinal axis extending parallel to the hinge members. The torsion spring 76 may be retained in position between the clamp member and bearing member by one or more of the thrust bearing members.

Figure 6:
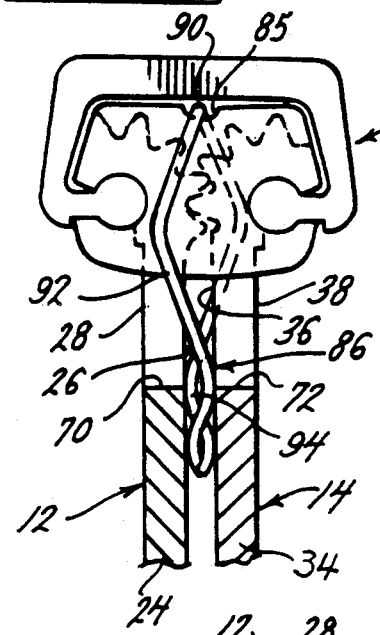
FIG. 6 is a partial sectional view similar to FIG. 4 showing the hinge members of the hinge structure in a closed position and, furthermore, illustrating an alternative design of the present invention.
Figure 7:
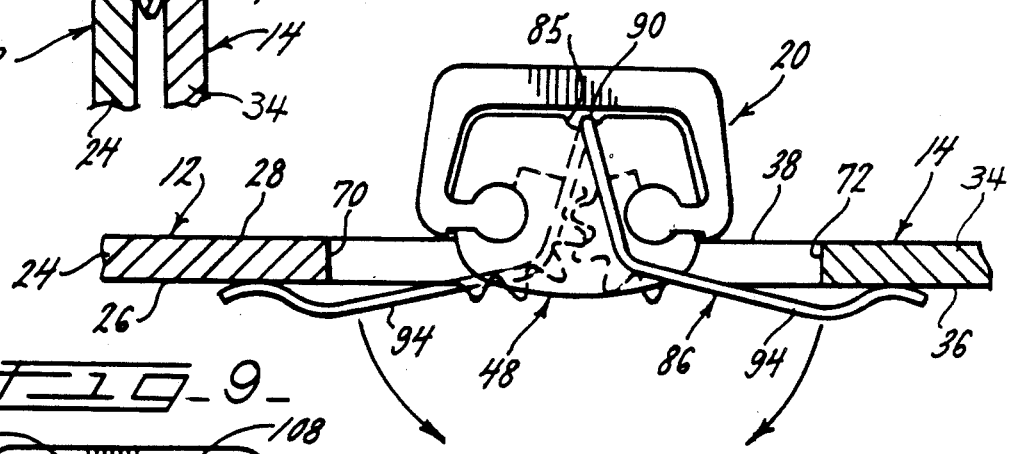
FIG. 7 is a partial sectional view similar to FIG. 6 illustrating the hinge members in an open position.

FIGS. 6 and 7 illustrate an alternative embodiment of a torsion spring 86 which is fabricated from substantially the same material as torsion spring 76. Like spring 76, spring 86 has a central portion 90 and opposed leg portions 92 and 94 which are longitudinally spaced from each other. As with spring 76, the length of central portion 90 should be maximized to reduce fatigue on the spring 86. Each leg portion of spring 86 laterally extends from the central portion 90 and through the lateral recess in the hinge member it engages. As with spring 76, the leg sections 92, 94 of spring 86 are provided with an angled or bent configuration to facilitate displacement thereof without operationally interfering with other parts on the hinge structure.

As illustrated in FIGS. 6 and 7, the central portion 90 of spring 86 longitudinally extends along the central groove 85 defined by the bearing member 50 to inhibit lateral shifting of the spring while allowing rotational movement of the central portion thereof. The leg portions 92, 94 extend laterally outwardly from the central portion 90 of the torsion spring 90. As with spring 76, the leg portions 92, 94 extends through longitudinally elongated recesses in the hinge members in a manner inhibiting longitudinal shifting of the upper and lower bearing member over which they pass and the free ends thereof press against and slidably engage the inner surfaces 26, 36 of the hinge members 12, 14, respectively. Having the leg portions 92, 94 engage the inner surfaces 26, 36 urges the hinge members from a closed position illustrated in FIG. 6, to an open position illustrated in FIG. 7.

Figure 8:
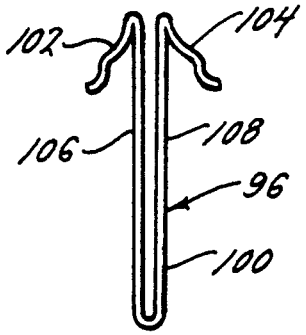
FIG. 8 is an elevational view of an alternative form of a torsion spring.

FIG. 8 illustrates another form of a torsion spring 96. Torsion spring 96 is fabricated from essentially the same material as spring 76 and includes a central portion 100 and opposed leg portions 102, 104. The central portion 100 of spring 100 is bent upon itself to form a U-shaped configuration having generally parallel sections 106 and 108. The length of leg sections 106 and 108 should be maximized to reduce spring fatigue. As illustrated, the U-shaped configuration of the spring 96 allows each leg portion 102, 104 to laterally extend away from the central portion 100 in generally coplanar relation to each other.

Figure 9:
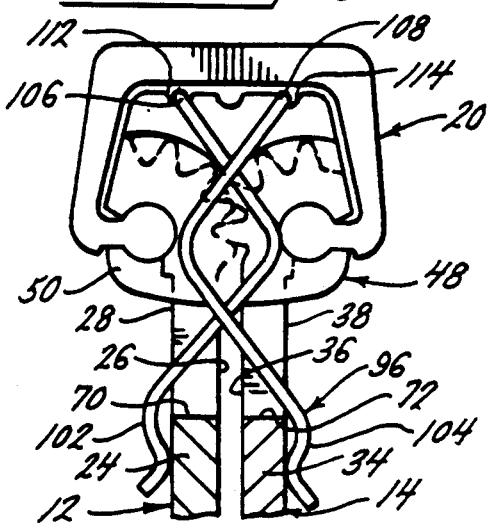
FIG. 9 illustrates a partial sectional view of a hinge structure having a torsion spring as illustrated in FIG. 8 arranged in combination therewith.

As illustrated in FIG. 9, the torsion spring 96 is operative to provide a self-operating feature to the hinge structure. The parallel leg sections 106, 108 of the torsion spring 96 are sufficiently close together that they may be inserted in a pair of parallel grooves 112 and 114 defined on the bearing member 50 (FIG. 3). Each leg portion 102, 104 of the spring 96 laterally extends away from the central portion 100, across an upper bearing surface of a thrust bearing assembly, and through the lateral recess in the hinge member it engages. As illustrated, the leg portions 102, 104 of the torsion spring 96 press against and slidably engage the outer surfaces 28, 38 of the hinge members 12, 14, respectively, in a manner urging the hinge members in opposite pivotal directions relative to each other. The leg portions 102, 104 are suitably configured to facilitate their movement without interfering with other parts on the hinge structure.

Figure 10:
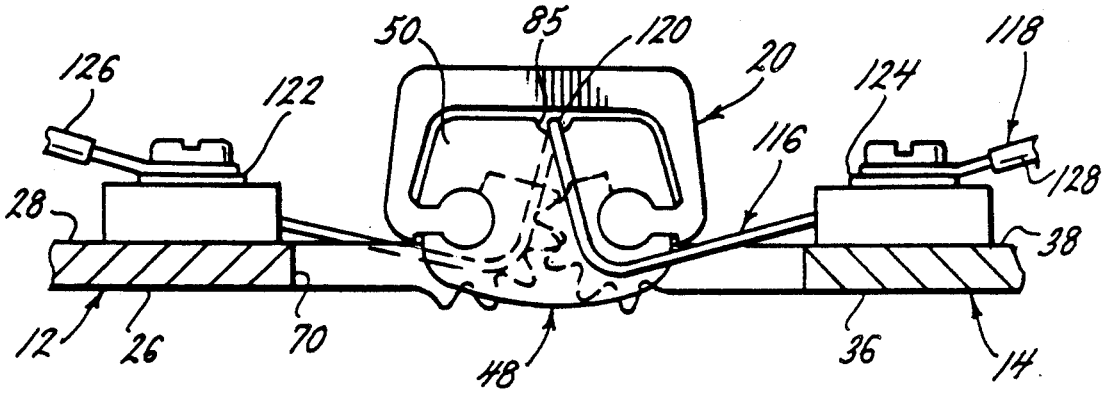
FIG. 10 is a partial sectional view illustrating the present invention used in combination with an electrical alarm system.

Another form of torsion spring 116 is illustrated in FIG. 10. Torsion spring 116 provides a self-operating feature to the hinge structure while also serving as part of an alarm system 118. The torsion spring 116 is shaped substantially similar to spring 76 discussed above and can be fabricated from any of several different materials including an insulated "piano wire," beryllium copper, or phosphor bronzes.

As illustrated, spring 116 includes a central portion 120 and opposed leg portions 122 and 124 which are longitudinally spaced from each other. Each leg portion 122, 124 laterally extends from the central portion 120, above and below respective bearing assemblies 48, and through the lateral recess in the hinge member it engages. As illustrated, the leg portions 122, 124 of the torsion spring press against and are secured to the hinge members 12, 14, respectively, in a manner urging the hinge members 12, 14 in opposite pivotal directions relative to each other.

As illustrated, the central portion 120 of the torsion spring 116 longitudinally extends through the central channel or retaining groove 85 formed in the thrust bearing member 50 for inhibiting lateral displacement of the spring. The leg portions 122 and 124 of the torsion spring 116 are electrically connected to suitable conduits 126, 128, respectively, which also form part of the alarm system 118.

Alternatively, electrical wires or conduits of an alarm system can be passed longitudinally along one or both of the channels 112, 114 provided on the bearing member 50. By longitudinally passing an electrical conduit along the length of the channels 112, 114, such conduits are protected by the clamp member against damage and/or severance.

Figure 11:
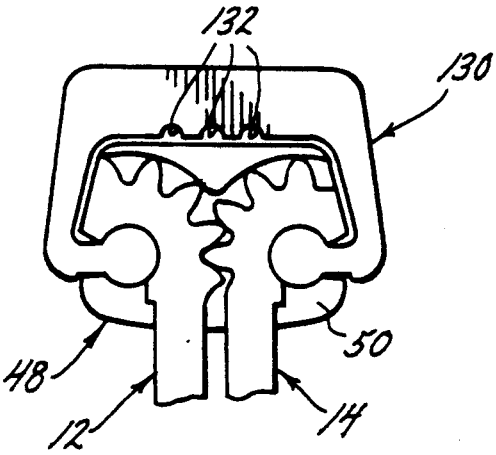
FIG. 11 is a partial sectional view similar to FIG. 2 illustrating an alternative embodiment of a clamp member.
Figure 12:
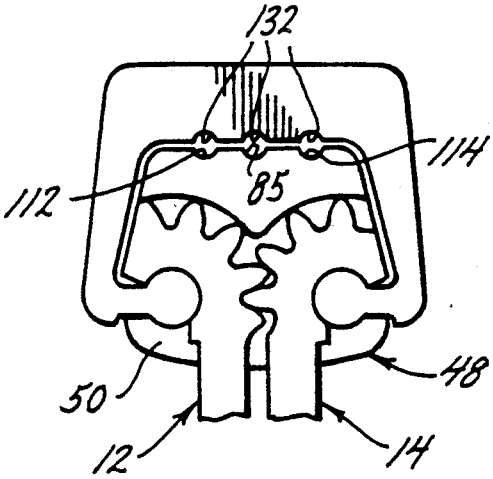
FIG. 12 is a partial sectional view similar to FIG. 2 showing an alternative embodiment of a thrust bearing assembly used in combination with the present invention.

FIG. 11 illustrates an alternative form of a clamp member 130 used to hold the hinge members 12, 14 in rotatable association relative to each other. Clamp member 130 is substantially similar to clamp member 20, illustrated in FIGS. 2 and 4, with the exception that clamp member 130 is provided with one or more grooves 132 provided along an interior surface thereof. The grooves 132 may be machined, or preferably extruded into the underside of the clamp member 130 and serve to retain the central portion of a torsion spring therewithin.

Alternatively, clamp member 130 with grooves 132 could be used in combination with a thrust bearing member 50 having one or more longitudinal grooves 85, 112, 114 formed thereon. Together, the thrust bearing member 50 and the clamp member 130 form one or more essentially circular openings or longitudinally extending grooves which serve to retain the central portion of a torsion spring and may further accommodate one or more electrical wires of an alarm system therewithin.

In each of the embodiments illustrated, the hinge members 12, 14 are movable between an open or first position and a closed or second position. The torsion spring arranged in combination with the hinge members imparts a self-operating feature or characteristic to the hinge structure. As illustrated in FIGS. 4 and 5, when the leg portions of the torsion spring engage an outer surface of the hinge members, the torsion spring imparts a self-closing characteristic to the hinge structure. Alternatively, when the leg portions of the torsion spring engage inner surfaces of the hinge members, a self-opening characteristic is imparted to the hinge structure. As will be appreciated, the torsional force imparted by the spring is dependent upon the length of the spring and the diameter or thickness thereof.

When the torsion spring is configured in a generally U-shape, the leg portions of the spring are anchored against the hinge members in such a way that they emerge from the interior of the clamp member at essentially the same longitudinal position relative to each other. With such design, the leg portions of the torsion spring laterally apply forces against the hinge members in opposition to each other while avoiding twisting action to the hinge structure because of the leg portions' generally co-equal longitudinal displacement along the length of the hinge members.

To inhibit lateral shifting of the torsion spring, one or more grooves may be provided in either the bearing member or the clamping member. Alternatively, the bearing member and clamping member can combine to define one or more retaining grooves for accommodating the central portion of the torsion spring which longitudinally extends along an interior surface of the clamping member.

When the torsion spring forms part of an alarm system, the torsion spring likewise serves as an electrical conduit serving to transmit electrical current across the hinge joint for actuating security monitoring equipment that can inform an observer as to various conditions of the hinge structure. Moreover, the ability to transfer electricity across the hinge joint of the hinge structure facilitates operation of electrically powered devices such as locks, panic bars, automatic actuators, and the like which are used in combination with doors on buildings, and etc.

Alternatively, electrical wires or conduits forming part of an alarm system can pass along the grooves provided in the bearing member and/or clamp member and be protected by the clamp member.

From the foregoing, it will be observed that numerous modifications and variations can be effected without departing from the true spirit and scope of the novel concept of the present invention. It will be appreciated that the present disclosure is intended to set forth exemplifications of the invention which are not intended to limit the invention to the specific embodiments illustrated. The disclosure is intended to cover by the appended claims all such modifications as fall within the scope of the claims.

I claim:

1. A pinless hinge structure comprising: a pair of longitudinally extending hinge members which are joined to each other at a longitudinally extending rotatable hinge joint for movement between open and closed positions, each of said hinge members having a longitudinally extending gear segment provided thereon; a longitudinally extending clamp member joined to said hinge members; and means engageable with both of said hinge members for resiliently urging them toward one of said positions, said means comprising part of an alarm system and serving to direct electrical currents across the hinge joint of the hinge structure.

2. A pinless hinge structure comprising: a pair of longitudinally extending hinge members which are joined to each other at a longitudinally extending rotatable hinge joint for movement between open and closed positions, each of said hinge members having a longitudinally extending gear segment provided thereon; a longitudinally extending clamp member joined to said hinge members; means engageable with both of said hinge members for resiliently urging them toward one of said positions; and thrust bearing means for inhibiting relative longitudinal movement between said hinge members, said thrust bearing means including means for retaining said resiliently urging means against lateral displacement.

3. The pinless hinge structure according to claim 2 wherein said resiliently urging means includes a torsion spring.

4. A pinless hinge structure comprising: two longitudinally extending hinge members, each hinge member including a gear segment extending along a longitudinal edge thereof; a longitudinally extending clamp member for maintaining the gear segments in mutually intermeshing relation relative to each other throughout their range of movement between open and closed positions; bearing means disposed in adjacent longitudinal coextensive lateral recesses defined along adjacent longitudinal edges of each hinge member for inhibiting longitudinal movement of the hinge members relative to each other; and torsion spring means for moving said hinge members in opposite pivotal directions relative to each other, said torsion spring means having opposed leg portions which engage said hinge members, each leg portions extending away from a central portion and through the recess defined by the hinge member which it engages, with the central portion of the spring longitudinally extending between said thrust bearing means and said clamp member.

5. The pinless hinge structure according to claim 4 wherein said bearing means defines a longitudinally extending channel which accommodates and retains the central portion of said torsion spring means therein to inhibit lateral movement of the spring means.

6. The pinless hinge structure according to claim 4 wherein each leg portion of said torsion spring means is electrically joined to an alarm system.

7. The pinless hinge structure according to claim 4 wherein said central portion of said torsion spring means has a generally U-shaped configuration with parallel sections, said parallel sections being retained within longitudinal channels defined on said bearing member.

8. The pinless hinge structure according to claim 4 wherein an interior surface of said clamp member defines at least one longitudinal channel which accommodates and retains the central portion of said torsion spring means therein to inhibit lateral movement of the spring means.

9. The pinless hinge structure according to claim 8 wherein said bearing means defines at least one longitudinally extending channel which is laterally aligned and in confronting relation with the channel defined on the interior surface of said clamp member, with the central portion of said spring means passing between and being retained by the longitudinal channels defined on said bearing means and said clamp member.

10. A hinge comprising: a first hinge member having a gear segment located along one of its edges and at least one recess opening out of the gear segment; a second hinge member having a gear segment located along one of its edges and at least one recess opening out of that gear segment, the gear segment of the second hinge member being presented toward and lying parallel to the gear segment of the first hinge member with the recess of the two hinge members located opposite to each other, so that the recess of the second member opens generally toward the recess of the first member; a bearing member located in the two recess of the hinge members for preventing the hinge members from being displaced longitudinally relative to each other; a clamp member coupled to the first and second hinge members in the regions of their gear segments and preventing the gear segments from moving apart; and a torsion spring including a rod that extends along the bearing member generally parallel to the gear segments and is connected at one end to the first hinge member and at its other end to the second hinge member such that it will exert a torque on the hinge members and urge them to an open or closed position.

11. A hinge according to claim 10 wherein the torsion spring includes leg portions which are directed laterally from the rod and bear against the hinge members remote from the gear segments.

12. A hinge according to claim 10 wherein the clamp member is generally C-shaped, having legs between which the two gear segments are located and a web connecting the legs; and wherein the rod is interposed between the bearing block and the web of the clamp member.

13. A hinge according to claim 10 wherein the gear segments of the first and second hinge members mesh.

14. A hinge according to claim 10 wherein each hinge member has several recesses, there being for each recess in the first hinge member a corresponding recess in the second hinge member; wherein each pair of corresponding recesses in the first and second hinge member contains a bearing member; and wherein the rod of the torsion spring extends along a plurality of bearing members.

15. A hinge according to claim 14 wherein leg portions of the torsion spring extend out of different recesses and bear against the hinge members remote from the gear segments.

16. A hinge according to claim 14 wherein the bearing members along which the rod of the torsion spring passes have grooves which receive the rod.

* * * * *